United States Patent [19]

Asami et al.

[11] Patent Number: 4,745,047

[45] Date of Patent: May 17, 1988

[54] COLOR IMAGE-FORMING PROCESS

[75] Inventors: Masahiro Asami; Kazunori Hasebe, both of Kanagawa, Japan

[73] Assignee: Fuji Photo Film Co., Ltd., Kanagawa, Japan

[21] Appl. No.: 7,227

[22] Filed: Jan. 27, 1987

[30] Foreign Application Priority Data

Jan. 24, 1986 [JP] Japan ..... 61-14545

[51] Int. Cl.[4] ..... G03C 7/30

[52] U.S. Cl. ..... 430/376; 430/372; 430/380; 430/393; 430/464; 430/467; 430/432; 430/473; 430/567; 430/569

[58] Field of Search ..... 430/464, 467, 372, 380, 430/432, 376, 393, 567, 569, 493

[56] References Cited

U.S. PATENT DOCUMENTS

| | | | |
|---|---|---|---|
| 3,935,014 | 1/1976 | Klotzer et al. | 430/567 |
| 3,996,054 | 12/1976 | Santemma et al. | 430/377 |
| 4,443,536 | 4/1984 | Lestina | 430/552 |
| 4,446,228 | 5/1984 | Honda et al. | 430/567 |
| 4,526,861 | 7/1985 | Ichijima et al. | 430/385 |
| 4,564,591 | 1/1986 | Tanaka et al. | 430/567 |
| 4,639,410 | 1/1987 | Mochizaki et al. | 430/567 |

FOREIGN PATENT DOCUMENTS

| | | | |
|---|---|---|---|
| 211437 | 2/1987 | European Pat. Off. . | |
| 29461 | 8/1974 | Japan . | |
| 52058 | 4/1980 | Japan . | |
| 036165 | 3/1981 | Japan | 430/567 |
| 184500 | 10/1982 | Japan | 430/567 |
| 200037 | 12/1982 | Japan . | |
| 31334 | 2/1983 | Japan . | |
| 42045 | 3/1983 | Japan . | |
| 50536 | 3/1983 | Japan . | |
| 48755 | 3/1984 | Japan . | |
| 080583 | 4/1984 | Japan | 430/567 |
| 178459 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 174836 | 10/1984 | Japan . | |
| 177553 | 10/1984 | Japan . | |
| 19140 | 1/1985 | Japan . | |
| 26338 | 2/1985 | Japan . | |
| 26339 | 2/1985 | Japan . | |
| 158446 | 8/1985 | Japan | 430/464 |
| 158444 | 8/1985 | Japan . | |
| 162256 | 8/1985 | Japan . | |
| 172042 | 9/1985 | Japan . | |
| 70552 | 4/1986 | Japan . | |
| 830250 | 2/1987 | Japan . | |
| 00046 | 1/1987 | PCT Int'l Appl. . | |
| 00062 | 1/1987 | PCT Int'l Appl. . | |
| 00110 | 2/1987 | PCT Int'l Appl. . | |

OTHER PUBLICATIONS

U.S. application Ser. No. 07/017,407, Koshimizu et al., 2/24/87.

U.S. application Ser. No. 07/018,380, Ishikawa et al., 2/24/87.

U.S. application Ser. No. 07/007,864, Sakai et al., 01/28/87.

U.S. application Ser. No. 07/037,288, Hirose et al., 4/10/87.

U.S. application Ser. No. 07/008,506, Ishikawa et al., 01/29/87.

U.S. application Ser. No. 07/013,513, Furutachi, 2/11/87.

U.S. application Ser. No. 07/015,400, Ishikawa et al., 2/17/87.

U.S. application Ser. No. 07/015,647, Fujita et al., 2/17/87.

U.S. application Ser. No. 07/008,436, Ishikawa et al., 1/29/87.

U.S. application Ser. No. 07/007,248, Kishimoto et al., 1/27/87.

U.S. application Ser. No. 07/008,450, Waki et al., 1/29/87.

U.S. application Ser. No. 06/927,490, Fujita et al., 11/6/86.

U.S. application Ser. No. 07/006,511, Hirose et al., 1/23/87.

U.S. application Ser. No. 07/007,201, Takahashi et al., 1/27/87.

U.S. application Ser. No. 07/007,207, Ogawa et al., 1/27/87.

U.S. application Ser. No. 07/039,203, Takahashi et al., 4/16/87.

U.S. application Ser. No. 07/051,437, Momuki et al., 5/17/86.

U.S. application Ser. No. 07/054,176, Fujimoto et al., 5/26/87.

*Primary Examiner*—Paul R. Michl
*Assistant Examiner*—Patrick A. Doody
*Attorney, Agent, or Firm*—Sughrue, Mion, Zinn, Macpeak, and Seas

[57] ABSTRACT

A color image-forming process is disclosed, which comprises imagewise exposing a silver halide photographic material comprising a reflective support having provided thereon at least one light-sensitive silver halide emulsion layer constituted by at least two kinds of monodispersed silver halide grains containing substantially no silver iodide and substantially deffering from each other in mean grain size, and developing the exposed photographic material for a developing time of within 2 minutes and 30 seconds using a color developer containing substantially no benzyl alcohol.

27 Claims, No Drawings

COLOR IMAGE-FORMING PROCESS

FIELD OF THE INVENTION

This invention relates to a color image-forming process, and, more particularly, to a color image-forming process which causes less environmental pollution and which enables to conduct rapid processing.

BACKGROUND OF THE INVENTION

As a technique for forming color photographic images, it has conventionally been well known to imagewise exposure a silver halide photographic material (hereinafter referred to as "photographic material") containing therein a color coupler or couplers capable of causing a coupling reaction with an oxidation product of an aromatic primary amine compound and forming a dye, and to dip the exposed photographic material in a color developer containing the aromatic primary amine compound as a color-developing agent, to thereby cause coupling reaction between the oxidation product of the aromatic primary amine compound produced as a result of "development" of the exposed silver halide grains with the color-developing agent (reduction of silver ion of silver halide) and the color coupler or couplers, thus forming dyes and providing a color image.

In this technique, natural color can be reproduced based on subtractive color process by using at least three kinds of light-sensitive emulsion layers, respectively having blue sensitivity, green sensitivity, and red sensitivity, as photographic material-constituting light-sensitive emulsion layers and incorporating in respective emulsion layers color couplers capable of forming yellow, magenta, and cyan dyes.

Removal of developed silver produced simultaneously with formation of dye image and of remaining non-developed silver halide by respectively bleaching and fixing provides a stable color photographic image.

Color couplers to be incorporated in the photographic materials are preferably used in the form of being dissolved in a high-boiling solvent and dispersed in a hydrophilic colloid, so-called oil-protected form, for the purpose of enhancing stability of produced dye images. Most of color photographic materials at present used in the photographic field are of this type.

In recent years, there has been an increasing demand for improved productivity in the photographic field, and rapid processing of large quantities of prints has been the most important problem to be solved. As a means for solving this problem, it has been considered most effective to shorten the time of developing photographic materials, particularly the time of developing color photographic printing paper.

In order to shorten the developing time, it is necessary to provide as high a color density as possible within a limited developing time. As a means for this purpose, it may be considered effective to use color couplers showing as fast a coupling reaction rate as possible, to use a silver halide emulsion which can easily be developed and can provide a high amount of developed silver per unit coated amount, or to use a color developer which shows a fast developing rate.

In general, it is known that the coupling reaction rate depends upon both the reactivity of the color couplers used and the permeability of the color developing agent of aromatic primary amine compound into oil droplets (containing a coupler).

As is described above, the use of highly reactive color couplers is of extreme importance. However, in selecting couplers to be used in photographic materials, couplers which possess many excellent properties are required. For example, couplers are required not to adversely affect a silver halide emulsion incorporated in a photographic material together with the coupler (such as not to increase fog or not to reduce sensitivity during storage), to form dyes having a preferable hue from the standpoint of color reproduction, to form dyes with high stability to heat or light, to have a high stability to heat or light, and the like. Therefore, couplers selected as couplers having generally excellent properties do not necessarily have a sufficiently high coupling reactivity.

For these reasons, various techniques for accelerating permeation of a color-developing agent into oil droplets have been examined. Of such techniques, the technique of adding benzyl alcohol to a color developer to accelerate development is at present being widely employed for processing color photographic printing papers, due to its large coloration-accelerating effect.

In the case of using benzyl alcohol, its low solubility in water requires the use thereof together with a solvent such as diethylene glycol, triethylene glycol, alkanolamine, etc. However, such compounds inclusive of benzyl alcohol have high BOD (biochemical oxygen demand) or COD (chemical oxygen demand) values, which are environmental load values, and hence elimination of benzyl alcohol is preferable from the standpoint of reducing the environmental load.

In addition, even when the above-described solvent is used, it requires some time to dissolve the benzyl alcohol. Thus, it is preferable not to use benzyl alcohol from the viewpoint of reducing the work of preparing the processing solution.

Furthermore, when benzyl alcohol is entrained into a post-developing bath such as a bleaching bath or a bleach-fixing bath, it can cause production of leuco dyes of cyan dyes, thus causing reduction of color density. Still further, since benzyl alcohol decelerates the rate of washing out developer components, it sometimes adversely affects image stability of processed photographic materials. Therefore, for the above-described reasons, too, it is preferable not to use benzyl alcohol.

In general, color development has conventionally been completed in 3 to 4 minutes. However, it has been desired to shorten the processing time even further.

However, elimination of a coloration accelerator such as benzyl alcohol and shortening of developing time necessarily lead to serious reduction of color density.

In order to solve this problem, various color development accelerators (for example, compounds described in U.S. Pat. Nos. 2,950,970, 2,515,147, 2,496,903, 2,304,925, 4,038,075, 4,119,462, British Pat. Nos. 1,430,998 and 1,455,413, Japanese Patent Application (OPI) Nos. 15831/78, 62450/80, 62451/80, 62452/80, and 62453/80 (the term "OPI" as used herein refers to a "published unexamined Japanese patent application"), Japanese Patent Publication Nos. 12422/76 and 49728/80) have been proposed for use together, but sufficient color density still can not be obtained.

Further, the technique of incorporating a 3-pyrazolidone or its derivative is known by Japanese Patent Application (OPI) Nos. 50536/83, 26338/85, 26339/85, 158444/85 and 158446/85.

Still further, the technique of incorporating a color-developing agent (described, for example, in U.S. Pat. Nos. 3,719,492, 3,342,559, 3,342,597, Japanese Patent Application (OPI) Nos. 6235/81, 16133/81, 97531/82, 83565/82, etc.) has the defect that color development is decelerated or that fog is formed.

The following various techniques have been known as well as the above-described techniques as the method that benzyl alcohol is eliminated from a color developer or the amount thereof added thereto is reduced.

The technique of incorporating benzyl alcohol or the derivatives thereof together with high boiling solvent in the form of dispersion into a layer adjacent to the emulsion layer in order to prevent admixture thereof with coupler is described in Japanese Patent Publication No. 29461/74.

Further, the technique comprising color development with a color developer, washing immediately after the color development, and then bleach-fix with bleach-fixing solution containing metal complex salt of organic acid is described in Japanese Patent Application (OPI) No. 52058/80.

Still further, the technique of using 2-acylamino-5-ureidophenol-type cyan coupler is described in Japanese Patent Application (OPI) No. 31334/83.

Even further, the technique of using pivoloyl acetanilide-type yellow coupler, 3-anilino-5-pyrazolone-type magenta coupler and 2,5-diacylaminophenol-type cyan coupler in combination thereof is described in Japanese Patent Application (OPI) No. 200037/82.

Further, the technique of using a photographic coupler wherein a naphthalene ring nucleus is present at the linking position other than coupling position and the naphthalene ring nucleus has at least one hydroxyl group and at least one sulfonyl group or has at least one hydroxyl group and at least one sulfinyl group is described in Japanese Patent Application (OPI) No. 174836/84.

A yet further, the technique of using a coupler having a ballast group represented by the following formula:

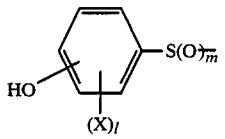

(wherein X represents a halogen atom or etc., l represents an integer of 1 to 4, and m represents 1 or 2) is described in Japanese Patent Application (OPI) No. 177553/84.

Further, the technique of using 4-mercapto-5-pyrazolone-type magenta coupler is described in Japanese Patent Application (OPI) No. 162256/85.

Further, the technique of effecting color development in the presence of compounds represented by the following formula (A) or (B):

$$R_1—O—R_2 \quad (A)$$

$$R_3—O—(CH_2)_nO—R_4 \quad (B)$$

(wherein $R_1$ and $R_2$ each represents an alkyl group, $R_3$ and $R_4$ each represents an alkyl group, and n represents 2 or 3) is described in Japanese Patent Application (OPI) No. 172042/85.

We, the inventors, have studied the above Japanese Patent Publication and Application (OPI)'s and have not been able to obtain a fully satisfactory result.

As is described above, no processes have been found for obtaining satisfactory color images in a short time by using a color developer which does not substantially contain benzyl alcohol.

On the other hand, as a technique for solving the above-described problems by accelerating development of a silver halide emulsion, it can be easily considered to increase the content of silver chloride in silver halides. However, an increase in the content of silver chloride involves the defect that reduction of sensitivity or formation of fog is liable to occur. In addition, for the purpose of increasing the amount of developed silver, it may be considered to increase the content of silver chloride as described above or to strengthen chemical sensitization. However, these steps may also cause formation of fog. Another technique for accelerating development involve reducing the grain size of silver halide emulsion. However, this technique has a serious defect of reduction of sensitivity. The technique of using a silver chloride emulsion is described, for example, in Japanese Patent Application (OPI) Nos. 95345/83, 232342/84, and 19140/85. According to this technique, when rapid processing is conducted using a color developer containing substantially no benzyl alcohol, such defect that harder tone cannot be obtained occurs.

Analysis by the inventors on the reduction of color density caused by substantially eliminating benzyl alcohol from the color developer has revealed the phenomenon that, when density of the dye is reduced, the amount of developed silver is also reduced. No improvement is found on this even when developing time is prolonged, which means that dead grains—silver halide grains not contributing to development in a limited development processing time using a substantially benzyl alcohol-free color developer—are produced. Such dead grains are considered grains having an extremely poor developing activity. They are produced due to some difference in properties of silver halide grains contained in an emulsion. Therefore, it would appear to be effective to use monodispersed silver halide grains in a silver halide emulsion, to thereby achieve uniform properties of respective grains, as disclosed or suggested in Japanese Patent Application (OPI) Nos. 48755/84, 26339/85 and 158446/85.

Experiments were conducted using silver halide emulsions containing highly monodispersed silver halide grains. However, though areas with an intermediate gradation are made contrasty and maximum density is raised to some extent, color-forming efficiencies in the shoulder part of the characteristic curve, which provides the density necessary for the reproduction of shadow areas in color prints, are insufficient, and hence such emulsions are still somewhat unsatisfactory for use in color photographic papers which are required to reproduce vivid tone from high-light areas to shadow areas.

It has been known in not only U.S. Pat. No. 4,446,228 but also Japanese Patent Application (OPI) No. 116347/86 that at least two kinds of monodispersed emulsions are mixed for the purpose of improving covering power or etc. However, these descriptions substantially relate to an X-ray photography, but are irrelevant to the color image-forming process of the present invention.

SUMMARY OF THE INVENTION

Therefore, an object of the present invention is to provide a color image-forming process which can provide a high color density in a short time even when a substantially benzyl alcohol-free color development processing solution is used.

The process of the present invention enables easy preparation of a development processing solution to be used for producing color prints.

The above-described object has been attained by a color image-forming process which comprises image-wise exposing a silver halide photographic material comprising a reflective support having provided thereon at least one light-sensitive silver halide emulsion layer constituted by at least two kinds of monodispersed silver halide grains containing substantially no silver iodide and substantially differing from each other in mean grain size, and developing the exposed photographic material for a developing time of within 2 minutes and 30 seconds using a color developer containing substantially no benzyl alcohol.

DETAILED DESCRIPTION OF THE INVENTION

A process for forming dye image which comprises image-wise exposing silver halide color photographic materials comprising light-sensitive silver halide emulsions containing 50 mol% or less of silver bromide in average and phenidone or the derivative thereof, and then processing the exposed materials with a color developer comprising benzyl alcohol in an amount of less than 2.0 ml/liter is described in Japanese Patent Application (OPI) No. 158446/85 as listed above. It is also described in the Japanese patent application (OPI) that two or more kinds of monodispersed silver halide emulsions separately prepared may be used in combination. However, it is not specifically described in Japanese patent application (OPI) that at least two kinds of monodispersed silver halide emulsions the silver halide grains of which differ from each other in mean grain size like the present invention are used in combination. It is, at all, unexpected from teachings of the prior arts that the coloring efficiency at shoulder area of characteristic curve is remarkably improved according to the present invention.

In the present invention, the terminology "containing substantially no benzyl alcohol" as used herein means that the concentration of benzyl alcohol in a color developer is less than 0.5 ml/liter, and preferably is zero.

The monodispersed silver halide grains to be used in the present invention preferably have a statistical standard deviation (S) of the grain size distribution to the mean grain size ($\bar{\gamma}$), a variation coefficient ($S/\bar{\gamma}$), of not more than 0.2, and more preferably not more than 0.15.

In the light-sensitive emulsion layer which characterizes the present invention, at least two kinds of the above-described monodispersed silver halide emulsions are used as a mixture. In this situation, the two kinds of the monodispersed silver halide grains, which are respectively the most and the second most by weight, preferably satisfy the condition of $$1.2 \leqq (\bar{\gamma}_1/\bar{\gamma}_2)^2 \leqq 4.0,$$

and more preferably $$1.4 \leqq (\bar{\gamma}_1/\bar{\gamma}_2)^2 \leqq 3.2,$$

wherein $\bar{\gamma}_1$ represents the mean grain size of the larger kind of grains, and $\bar{\gamma}_2$ represents the mean grain size of the smaller kind of grains.

$\bar{\gamma}_1$ and $\bar{\gamma}_2$ are each preferably within the range of from 0.1 μm to 2.0 μm, and more preferably 0.2 μm to 1.3 μm.

As to the mixing proportion of the monodispersed emulsions in the present invention, the sum of the monodispersed emulsions having mean grain sizes of $\bar{\gamma}_1$ and $\bar{\gamma}_2$, respectively, is preferably 70% or more, and more preferably 80% or more, by weight based on the total silver halide emulsions contained in the light-sensitive emulsion layer. The weight ratio of monodispersed emulsion having a mean grain size of $\bar{\gamma}_2$ to monodispersed emulsion having a mean grain size of $\bar{\gamma}_1$ is preferably in the range of from 5/95 to 80/20, and more preferably from 10/90 to 70/30.

In the present invention, at least two kinds of monodispersed silver halide emulsions are preferably blended after adding thereto a spectrally sensitizing dye.

The grain size distribution and the mean grain size of silver halide grains may be determined by a method described in detail in T. H. James, *The Theory of the Photographic Process* (1977, Macmillan), Chapter 3, p. 100 et seq., i.e., by measuring projected area of silver halide grains utilizing an electron micrograph and statistically processing the data. As to mean grain size, number-average mean grain size is used.

The monodispersed silver halide emulsions to be used in the present invention comprise silver chloride, silver bromide and/or silver chlorobromide containing substantially no silver iodide and are preferably silver chlorobromide emulsion containing from 20 to 98 mol%, and more preferably from 50 to 98 mol% of silver bromide. On the other hand, it is preferred to use silver chloride or silver chlorobromide containing 80 mol% or more of silver chloride for the purpose of much more rapid color development.

Several techniques have conventionally been known to incorporate two or more kinds of monodispersed silver halide emulsions in the same light-sensitive emulsion layer, and are described, for example, in Japanese Patent Application (OPI) Nos. 150841/82, 178235/82, 14829/83, etc. However, such conventional disclosed techniques relate to widening of exposure latitude (i.e., making tone soft), improvement of graininess, or improvement of sharpness.

Accordingly, the effect of the present invention that reduction of density (particularly in shoulder part of characteristic curve) having been caused when rapid processing is conducted using a substantially benzyl alcohol-free color developer can be markedly depressed is quite novel and can not be expected from the prior art.

The silver halide grains to be used in the present invention may be of a layered structure wherein the inner portion and the surface layer are different from each other (a core/shell structure), of a multi-phase structure having a conjunction structure, or of a uniform phase, or may be a mixture thereof.

It is most preferred in the present invention to use a monodispersed silver chlorobromide grain having a core/shell structure wherein the shell portion has a larger amount of silver chloride content than does the core portion.

Silver halide grains to be used in the present invention may be in a regular crystal form such as cubic, octahedral, dodecahedral or tetradecahedral form, in an irregular crystal form such as spherical form, or in a mixed form thereof, with regular crystals being preferable. In addition, tabular grains may be used. In particular, an emulsion wherein tabular grains having a length-to-thickness ratio of 5 or more, and particularly 8 or more, account for 50% or more of the total projected area of the grains may be used. Emulsions comprising a mixture of these various crystals may also be used. These various emulsions may be either of the type forming a latent image mainly on the surface of the grains (surface latent image type) or of the type forming a latent image within the grains (internal latent image type).

The monodispersed silver halide grains to be used in the present invention preferably form a latent image predominantly on the surface thereof upon exposure to light.

The photographic emulsion to be used in the present invention can be prepared by the processes described in P. Grafkides, *Chimie et Physique Photographoque* (Paul Montal, 1967); G. F. Duffin, *Photographic Emulsion Chemistry* (Focal Press, 1966); Zelikman et al, *Making and Coating Photographic Emulsion* (Focal Press, 1964); etc. Any of an acidic process, a neutral process and an ammoniacal process can be used. As a manner of reacting a soluble silver salt with a soluble halogen salt, any of single-jet method, double-jet method, or a combination thereof may be employed.

A process of forming grains in the presence of excess silver ion (so-called reverse mixing method) can be employed as well. As one type of the double-jet method, a process called controlled double-jet method wherein pAg in a liquid phase in which silver halide is formed is kept constant can be employed. This method provides a silver halide emulsion containing silver halide grains having an approximately uniform particle size.

In addition, emulsions prepared according to a so-called conversion method which involves the step of converting once formed silver halide to silver halide having a lower solubility before the completion of formation of the silver halide grains, and emulsions having subjected to the same conversion method after the completion of the formation of silver halide grains, may be used.

During formation or physical ripening of silver halide grains, cadmium salts, zinc salts, lead salts, thallium salts, iridium salts or complex salts thereof, rhodium salts or complex salts thereof, iron salts or complex salts thereof, etc., may be present in order to prevent reciprocity failure, increase sensitivity, control gradation and the like.

Formed silver halide emulsions are usually subjected to physical ripening, desalting, and chemical ripening before being coated.

Known silver halide solvents (for example, ammonia, potassium thiocyanate, and thioethers and thione compounds such as are described in U.S. Pat. No. 3,271,157, Japanese Patent Application (OPI) Nos. 12360/76, 82408/78, 144319/78, 100717/79, 155828/79) may be used in the steps of flocculation, physical ripening, and chemical ripening. In order to remove soluble silver salts from an emulsion having been subjected to physical ripening, a noodle-washing method, a flocculation method, an ultrafiltration method, etc. may be employed.

Silver halide emulsions to be used in the present invention may be chemically sensitized according to sulfur sensitization using active gelatin or sulfur-containing compounds capable of reacting with silver (e.g., thiosulfates, thioureas, mercapto compounds, rhodanines, etc.); reduction sensitization using a reductive substance (e.g., stannous salts, amines, hydrazine derivatives, formamidine-sulfinic acid, silane compounds, etc.); and noble metal sensitization using compounds of noble metals (e.g., complex salts of the metals belonging the group VIII in the periodic table such as Pt, Ir, Pd, Rh, Fe, etc. as well as gold complex salts) may be employed alone or in combination.

Of the above-described chemical sensitizations, independent use of the sulfur sensitization is preferable.

Blue-sensitive, green-sensitive, and red-sensitive emulsions to be used in the present invention are emulsions spectrally sensitized with methine dyes or the like to possess respective color sensitivities. Dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. In these days, any nuclei ordinarily used as basic hetero ring nuclei in cyanine dyes can be used. This includes, for example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are condensed with an alicyclic hydrocarbon ring; and those in which these nuclei are condensed with an aromatic hydrocarbon ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. can be used. These nuclei may be substituted in the carbon atoms.

In the merocyanine dyes or complex merocyanine dyes, 5- or 6-membered hetero ring nuclei such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, etc., may be used as a ketomethylene structure-containing nucleus.

These sensitized dyes may be used alone or in combination. Combinations of sensitizing dyes are often employed, particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281 and 1,507,803, Japanese Patent Publication Nos. 4936/68 and 12375/78, Japanese Patent Application (OPI) Nos. 110618/77 and 109925/77.

A dye which itself does not have a spectrally sensitizing effect or a substance which substantially does not absorb visible light, but which shows a supersensitizing effect, may be incorporated together with the sensitizing dye.

In the present invention, the sensitizing dyes may be added to silver halide photographic emulsion in any step before coating the emulsion on a support.

That is, the dyes may be added in any of the step of forming grains of silver halide emulsion, the step after the grain formation, and before or after chemical sensitization, and the step of adding additives for preparing a coating solution.

In addition, the sensitizing dyes may be preliminarily added to respective monodispersed emulsions to be used as a mixture in the present invention, or may be added after mixing the emulsions, with the former manner of preliminarily adding to respective emulsions before mixing being better.

Color couplers to be incorporated in the photographic material are preferably non-diffusible couplers having a ballast group or being polymerized. 2-equivalent color couplers wherein the coupling-active site is substituted by a coupling-off group can reduce the amount of silver to be coated in comparison with 4-equivalent color couplers wherein the coupling-active site is occupied by a hydrogen atom. Couplers which produce dyes with proper diffusibility, colorless compound-forming couplers, DIR couplers capable of releasing a development inhibitor upon coupling reaction, or couplers capable of releasing a development accelerator are also usable.

As the yellow couplers to be used in the present invention, oil protection type acylacetamide type couplers are illustrated as typical examples. Specific examples thereof are described in U.S. Pat. Nos. 2,407,210, 2,875,057, and 3,265,506, etc. In the present invention, the use of 2-equivalent yellow couplers is preferable, and typical examples thereof include yellow couplers having oxygen-atom-linked coupling-off groups as described in U.S. Pat. Nos. 3,408,194, 3,447,928, 3,933,501, 4,022,620, etc. and yellow couplers having nitrogen-atom-linked coupling-off groups described in Japanese Patent Publication No. 10739/83, U.S. Pat. Nos. 4,401,752, 4,326,024, *Research Disclosure,* RD No. 18053 (April, 1979), British Pat. No. 1,425,020, West German Patent Application (OLS) Nos. 2,219,917, 2,261,361, 2,329,587, 2,433,812, etc. α-Pivaloylacetanilide type couplers are excellent in fastness, particularly light fastness, of dyes, whereas α-benzoylacetanilide type couplers provide high color density.

Magenta couplers to be used in the present invention include oil protection type indazolone type or cyanoacetyl type, preferably 5-pyrazolone type and pyrazoloazole type (e.g., pyrazolotriazoles), couplers. Of the 5-pyrazolone type couplers, those which are substituted by an arylamino group or an acylamino group in the 3-position are preferable in view of hue and color density of dyes. Typical examples thereof are described in U.S. Pat. Nos. 2,311,082, 2,343,703, 2,600,788, 2,908,573, 3,062,653, 3,152,896, 3,936,015, etc. As coupling-off groups for 2-equivalent, 5-pyrazolone type couplers, nitrogen-atom-linked coupling-off groups described in U.S. Pat. No. 4,310,619 and arylthio groups described in U.S. Pat. No. 4,351,897 are particularly preferable. Ballast group-containing, 5-pyrazolone type couplers described in European Pat. No. 73,636 provide high color density.

Examples of pyrazoloazole type couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure,* RD No. 24220 (June, 1984), and pyrazolopyrazoles described in *Research Disclosure,* RD No. 24230 (June, 1984). Imidazo[1,2-b]pyrazoles described in European Pat. No. 119,741 are preferable in view of little yellow side absorption of dyes, and pyrazolo[1,5-b][1,2,4]triazoles described in European Pat. No. 119,860 are particularly preferable.

Cyan couplers to be used in the present invention include oil protection type naphthol type and phenol type couplers. Typical examples thereof include naphthol type couplers described in U.S. Pat. No. 2,474,293, preferably oxygen-atom-linked coupling-off type 2-equivalent naphthol type couplers described in U.S. Pat. Nos. 4,052,212, 4,146,396, 4,228,233, and 4,296,200.

Specific examples of the phenol type couplers are described in U.S. Pat. Nos. 2,369,929, 2,801,171, 2,772,162, 2,895,826, etc. Cyan couplers fast against high humidity and high temperature are preferably used in the present invention, and typical examples thereof include phenol type cyan couplers having an alkyl group having 2 or more carbon atoms at an m-position of the phenol nucleus, described in U.S. Pat. No. 3,772,002, 2,5-diacylamino-substituted phenol type couplers described in U.S. Pat. Nos. 2,772,162, 3,758,308, 4,126,396, 4,334,011, 4,327,173, West German Patent Application (OLS) No. 3,329,729, Japanese Patent Application No. 42671/83 (corresponding to Japanese Patent Application (OPI) No. 166956/84), etc., and phenol type couplers having a phenylureido group in 2-position and an acylamino group in 5-position, described in U.S. Pat. Nos. 3,446,622, 4,333,999, 4,451,559, 4,427,767, etc.

Graininess can be improved by using those couplers which dyes with a proper diffusibility. As such couplers forming properly diffusible dyes, U.S. Pat. No. 4,366,237 and British Pat. No. 2,125,570 describe specific examples of magenta couplers, and European Pat. No. 96,570 and West German Patent Application (OLS) No. 3,234,533 describe specific examples of yellow, magenta, or cyan couplers.

The dye-forming couplers and the above-described special couplers may form a dimer or higher polymer. Typical examples of polymerized, dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

Two or more of the various couplers to be used in the present invention may be used in one and the same light-sensitive layer, or one and the same compound may be used in two or more layers for obtaining photographic characteristics required for a particular photographic material.

The couplers to be used in the present invention may be introduced into a photographic material according to the oil-in-water dispersion method. In the oil-in-water dispersion method, a coupler or couplers are dissolved in a single liquid or a mixed solution of high-boiling organic solvents having a boiling point of 175° C. or above and low-boiling auxiliary solvents, then finely dispersing the resulting solution in water or an aqueous medium such as a gelatin aqueous solution in the presence of a surfactant. Examples of high-boiling organic solvents are described in U.S. Pat. No. 2,322,027, etc. The dispersion may be accompanied by phase inversion. If necessary, the auxiliary solvent may be removed, or partly removed, from the coupler dispersion before being coated, by distillation, noodle-washing with water, ultrafiltration, or the like.

Specific examples of the high-boiling organic solvents include phthalates (e.g., dibutyl phthalate, dicyclohexyl phthalate, di-2-ethylhexyl phthalate, decyl phthalate, etc.), phosphates or phosphonates (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.), benzoates (e.g., 2-ethylhexyl benzoate, dodecyl benzoate, 2-ethylhexyl p-hydroxybenzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylates (e.g., dioctyl azelate, glycerol tributylate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc. As the auxiliary solvents, organic solvents having a boiling point of about 30° C. or above, and preferably above 50° C. to about 160° C., may be used. Typical examples thereof include ethyl acetate, butyl acetate, ethyl propionate, methyl ethyl ketone, cyclohexanone, 2-ethoxyethyl acetate, dimethylformamide, etc.

The latex-dispersing method, effects thereof, and specific examples of latexes for impregnation are described in U.S. Pat. No. 4,199,363, West German Patent Application (OLS) Nos. 2,541,274 and 2,541,230, etc.

A standard amount of a color coupler to be used in the present invention is in the range of from 0.001 to 1 mol per mol of light-sensitive silver halide, and, preferably, a yellow coupler is used in an amount of 0.01 to 0.5 mol, a magenta coupler in an amount of 0.003 to 0.3 mol, and a cyan coupler in an amount of 0.002 to 0.3 mol, per mol of light-sensitive silver halide.

Photographic materials prepared according to the present invention may contain hydroquinone derivatives, aminophenol derivatives, amines, gallic acid derivatives, catechol derivatives, ascorbic acid derivatives, colorless compound-forming couplers, sulfonamidophenol derivatives, etc., as color fog-preventing agents or color stain-preventing agents.

The photographic material of the present invention may contain known discoloration inhibitors. Typical examples of organic discoloration inhibitors include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines, ether derivatives of these compounds prepared by silylation or alkylation of the phenolic hydroxy group, and ester derivatives thereof. In addition, metal complexes represented by (bissalicylaldoximato)nickel complexes and (bis-N,N-dialkyldithiocarbamato)nickel complexes may also be used.

Compounds having the partial structure of both hindered amine and hindered phenol, as described in U.S. Pat. No. 4,268,593, are effective for preventing yellow dye images from being deteriorated by heat, high humidity, and light. In addition, spiroindanes described in Japanese Patent Application (OPI) No. 159644/81 and chromans substituted by hydroquinones diether or monoether and described in Japanese Patent Application (OPI) No. 89835/80 are effective for preventing magenta dye images from being deteriorated by, particularly, light.

In order to improve preservability, particularly light fastness, of cyan dye images, combined use of benzotriazole type ultraviolet absorbents is preferable. This ultraviolet absorbents may be co-emulsified with a cyan coupler.

The ultraviolet absorbent is used in a sufficient amount to provide a cyan dye image with light stability. However, when used in an excessive amount, it can cause yellowing of unexposed area (white background) of a color photographic material. Therefore, the ultraviolet absorbent is usually used in an amount of from $1\times10^{-4}$ mol/m$^2$ to $2\times10^{-3}$ mol/m$^2$, and preferably $5\times10^{-4}$ mol/m$^2$ to $1.5\times10^{-3}$ mol/m$^2$.

In the light-sensitive layer structure of an ordinary color paper, the ultraviolet absorbent is incorporated in either, preferably both, of layers adjacent to a cyan coupler-containing red-sensitive emulsion layer. In the case of adding the ultraviolet absorbent to an interlayer between a green-sensitive layer and a red-sensitive layer, it may be co-emulsified with a color stain-preventing agent. Where the ultraviolet absorbent is added to a protective layer, another protective layer may be provided as an outermost layer. In this outermost protective layer may be incorporated a matting agent, etc.

In the photographic material of the present invention, the ultraviolet absorbent may be added to a hydrophilic colloid layer.

The photographic material of the present invention may contain in its hydrophilic colloid layer a water-soluble dye as a filter dye or for various purposes such as prevention of irradiation or halation.

The photographic material of the present invention may contain in its photographic emulsion layer or other hydrophilic colloid layer a whitening agent such as a stilbene type one, triazine type one, oxazole type one, or coumarin type one. Water-soluble ones may be used, or water-insoluble whitening agents may be used in the form of a dispersion.

As has been described hereinbefore, the present invention may also be applied to a multi-layered, multicolor photographic material comprising a support having provided thereon at least two layers different from each other in spectral (color) sensitivity. Multi-layered, natural color photographic materials usually comprise a support having provided thereon at least one red-sensitive emulsion layer, at least one green-sensitive emulsion layer, and at least one blue-sensitive emulsion layer. The order of these layers may be optionally selected as the case demands. Each of the aforesaid emulsion layers may comprise two or more emulsion layers having different sensitivities, and a light-insensitive layer may be provided between two or more layers having the same color sensitivity.

In the photographic material in accordance with the present invention, auxiliary layers such as a protective layer, an interlayer, a filter layer, an antihalation layer, a backing layer, etc., may preferably be provided in addition to the silver halide emulsion layers.

As a binder or protective colloid to be used in the emulsion layer or the interlayer of the photographic material of the present invention, gelatin is advantageously used. However, other hydrophilic colloids can be used as well. For example, proteins such as gelatin derivatives, graft polymers between gelatin and other high polymers, albumin, casein, etc.; cellulose derivatives such as hydroxyethylcellulose, carboxymethylcellulose, cellulose sulfate, etc.; sugar derivatives such as sodium alginate, starch derivatives, etc.; and various synthetic hydrophilic polymeric substances such as homopolymers or copolymers (e.g., polyvinyl alcohol, partially acetallized polyvinyl alcohol, poly-N-vinylpyrrolidone, polyacrylic acid, polymethacrylic acid, polyacrylamide, polyvinylimidazole, polyvinyl pyrazole, etc.) can be used.

As gelatin, acid-processed gelatin or enzyme-processed gelatin as described in *Bull. Soc. Sci. Phot. Japan,* No. 16, p. 30 (1966) may be used, as well as lime-processed gelatin, and a gelatin hydrolyzate or an enzyme-decomposed product can also be used.

Various stabilizers, stain-preventing agents, developing agents or precursors thereof, development accelerators or precursors thereof, lubricants, mordants, matting agents, antistatic agents, plasticizers, or other various additives useful for photographic light-sensitive materials may be added to the photographic material of the present invention in addition to the aforementioned additives. Typical examples of these additives are described in *Research Disclosure,* RD No. 17643 (Dec., 1978) and ibid., RD No. 18716 (Nov., 1979).

The "reflective support" to be used in the present invention means a support that enhances reflectivity to make a dye image formed in a silver halide emulsion layer distinct, and includes those which comprise a support having coated thereon a hydrophobic resin containing dispersed therein a light-reflecting substance such as titanium oxide, zinc oxide, calcium carbonate, or calcium sulfate, and those which use as a support a hydrophobic resin containing dispersed therein a light-reflecting substance. As the reflective supports, there are illustrated, for example, baryta paper, polyethylene-coated paper, polypropylene type synthetic paper, transparent supports having provided thereon a reflective layer or having a reflective substance, such as glass plate, polyester film (e.g., polyethylene terephthalate, cellulose triacetate, or cellulose nitrate), polyamide film, polycarbonate film, polystyrene film, etc. The most appropriate support may be selected from the foregoing supports depending upon the particular intended end-use.

Processing steps (image-forming steps) employed in the present invention are described below.

The color-developing step in the present invention is conducted in a processing time of within 2 minutes and 30 seconds, and preferably is from 1 minute to 2 minutes and 10 seconds. The expression "processing time" as used herein means a period from the time at which a photographic material is brought into contact with a color developer to the time of the photographic material coming into contact with a next bath, involving the time necessary for transporting the photographic material from bath to bath.

The color developer to be used in the present invention is preferably an alkaline aqueous solution containing an aromatic primary amine color-developing agent as a main ingredient. As this color-developing agent, p-phenylenediamine type compounds are preferably used. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides, phosphates, p-toluenesulfonates, tetraphenylborates, p-(t-octyl)benzenesulfonates thereof. Preferred examples thereof include 3-methyl-4-amino-N-ethyl-N-β-hydroxyethylaniline and 3-methyl-4-amino-N-ethyl-N-β-methanesulfonamidoethylaniline. More preferred example thereof includes 3-methyl-4-amino-N-ethyl-N-β-methanesulfonamidoethylaniline.

Aminophenol derivatives include, for example, o-aminophenol, p-aminophenol, 4-amino-2-methylphenol, 2-amino-3-methylphenol, 2-hydroxy-3-amino-1,4-dimethylbenzene, etc.

In addition, those which are described in L. F. A. Mason, *Photographic Processing Chemistry* (Focal Press), pp. 226–229, U.S. Pat. Nos. 2,193,015, 2,592,364, Japanese Patent Application (OPI) No. 64933/73, etc., may also be used. Tow or more color-developing agents may be used in combination.

Processing temperature of the color developer to be used in the present invention is preferably from 30° to 50° C., and more preferably from 35° to 45° C.

As the development-accelerator, various compounds may be used provided that benzyl alcohol is not substantially contained therein. Examples include various pyridinium compounds represented by those described in U.S. Pat. No. 2,648,604, Japanese Patent Publication No. 9503/69, U.S. Pat. No. 3,171,247 and other cationic compounds, cationic dyes such as phenosafranine, neutral salts such as thallium nitrate and potassium nitrate, polyethylene glycol and derivatives thereof described in Japanese Patent Publication No. 9304/69, U.S. Pat. Nos. 2,533,990, 2,531,832, 2,950,970 and 2,577,127, nonionic compounds such as polythioethers, thioether compounds described in U.S. Pat. No. 3,201,242, and those described in Japanese Patent Application (OPI) Nos. 156934/83 and 220344/85.

In short-time development processing as in the present invention, not only the technique of accelerating development, but also the technique of preventing fog becomes important. As antifoggants to be used in the present invention, alkali metal halides (e.g., potassium bromide, sodium bromide, potassium iodide, etc.) and organic antifoggants are preferable. As the organic antifoggants, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, hydroxyazaindolizine, mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thiosalicyclic acid may be used, with halides being particularly preferable. These antifoggants may be dissolved out of color light-sensitive materials during the processing to accumulate in a color developer.

In addition, the color developer to be used in the present invention may contain pH buffer agents such as an alkali metal carbonate, borate or phosphate; preservatives such as hydroxylamine, triethanolamine, those described in West German Patent Application (OLS) No. 2,622,950, sulfites or bisulfites; organic solvents such as diethylene glycol; dye-forming couplers; competitive couplers; nucleating agents such as sodium borohydride; auxiliary developing agents such as 1-phenyl-3-pyrazolidone; viscosity-imparting agents; and chelating agents such as aminopolycarboxylic acids (represented by ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and those described in Japanese Patent Application (OPI) No. 195845/83), 1-hydroxyethylidene-1,1'-diphosphonic acid, organic phosphonic acids described in *Research Disclosure,* RD No. 18170 (May, 1979), aminophosphonic acids such as aminotris(methylenephosphonic acid), ethylenediamine-N,N,N',N'-tetramethylenephosphonic acid, etc., and phosphonocarboxylic acids described in Japanese Patent Application (OPI) Nos. 102726/77, 42730/78, 121127/79, 4024/80, 4025/80, 126241/80, 65955/80, 65956/80, and *Research Disclosure,* RD No. 18170 (May, 1979).

The color-developing bath may, if desired, be divided into two or more portions, and a color development replenisher may be added to the foremost or aftermost bath to shorten the developing time or reduce the amount of the replenisher.

Color-developed silver halide color photographic materials are usually bleached. Bleaching may be conducted independently or simultaneously with fixing (bleach-fixing). As bleaching agents, compounds of polyvalent metals such as iron (III), cobalt (III), chromium (VI), copper (II), etc., peracids, quinones, nitroso compounds, etc., are used. Examples include ferricyanides; dichromates; organic complex salts of iron (III) or cobalt (III). Other examples include complex salts of aminopolycarboxylic acids such as ethylenediaminetetraacetic acid, diethylenetriaminepentaacetic acid, nitrilotriacetic acid, 1,3-diamino-2-propanoltetraacetic acid, etc. or of organic acids such as citric acid, tartaric acid, malic acid, etc.; persulfates; manganates; nitrosophenols, etc., may be used. Of these, potassium ferricyanide, sodium ethylenediaminetetraacetato ferrate, ammonium ethylenediaminetetraacetato ferrate, ammonium triethylenetetraminepentaacetato ferrate, and persulfates are particularly preferable. Ethylenediaminetetraacetato ferrate complex salts are useful in both an independent bleaching solution and in a mono-bath blix solution.

The bleaching solution and bleaching-fixing solution may contain, if desired, various accelerators. For example, thiourea type compounds as shown in U.S. Pat. No. 3,706,561, Japanese Patent Publication Nos. 8506/70, 26586/74, Japanese Patent Application (OPI) Nos. 32735/78, 36233/78, and 37016/78; thiol type compounds shown in Japanese Patent Application (OPI) Nos. 124424/78, 95631/78, 57831/78, 32736/78, 65732/78, and 52534/79, U.S. Pat. No. 3,893,858, etc.; heterocyclic compounds described in Japanese Patent Application (OPI) Nos. 59644/74, 140129/75, 28426/78, 141623/78, 104232/78, and 35727/79; thioether type compounds described in Japanese Patent Application (OPI) Nos. 20832/77, 25064/80, and 26506/80, etc.; quaternary amines described in Japanese Patent Application (OPI) No. 84440/73; thiocarbamoyl compounds described in Japanese Patent Application (OPI) No. 42349/84; etc., may be used alone or as a combination of two or more as well as bromide ion and iodide ion.

As fixing agents, there are illustrated thiosulfates, thiocyanates, thioether type compounds, thioureas, a large amount of iodide, etc., with the use of thiosulfates being popular. As preservatives for the bleach-fixing solution or a fixing solution, sulfites, bisulfites, or carbonyl-bisulfite adducts are preferable.

After the bleach-fixing or fixing, water-washing is usually connected. In the water-washing step, various known compounds may be added for the purpose of preventing precipitation or saving water. For example, in order to prevent precipitation, water softeners such as inorganic phosphoric acids, aminopolycarboxylic acids, organophosphoric acids, etc., may be added, and antibacterial agents and antifungal agents for preventing growth of various bacteria, algae, fungi, etc., hardeners represented by magnesium salts and aluminum salts, surfactants for reducing drying load or preventing drying unevenness, etc. may be added, as the case demands. Compounds which are described in L. E. West, *Phot. Sci. and Eng.,* Vol. 9, No. 6 (1965), etc., may also be added. Of these, chelating agents and antifungal agents are particularly effective. The water-washing step may be conducted by a multi-step (for example, 2- to 5-step) countercurrent washing to save water.

Further, after or in place of the water-washing step, multi-stage countercurrent stabilize-processing step as described in Japanese Patent Application (OPI) No. 8543/82 may be conducted. In this step, 2 to 9 countercurrent baths are necessary. Various compounds are added to the stabilizing baths for the purpose of stabilizing images. For example, buffers for adjusting the pH (for example, borates, metaborates, borax, phosphates, carbonates, potassium hydroxide, sodium hydroxide, aqueous ammonia, monocarboxylic acids, dicarboxylic acids, polycarboxylic acids, etc.) and formalin can be used. In addition, water softeners (e.g., inorganic phosphoric acids, aminopolycarboxylic acids, organic phosphoric acids, aminopolycarboxylic acids, phosphonocarboxylic acids, etc.), biocide (e.g., Proxel, isothiazolone, 4-thiazolylbenzimidazole, halogenated phenol benzotriazole, etc.), sulfactants, brightening agents, hardeners, etc. may be usd as the case demands.

Further, addition of various ammonium salts such as ammonium chloride, ammonium nitrate, ammonium sulfate, ammonium phosphate, ammonium sulfite, ammonium thiosulfate, etc., as agents for adjusting pH of processed films may be conducted.

The present invention is now described in greater detail by reference to the following examples, which, however, are not to be construed as limiting the present invention in any way. Unless otherwise indicated, percent values are by weight.

EXAMPLE 1

A multi-layer color photographic printing paper comprising a paper support laminated with polyethylene on both surfaces thereof having provided thereon the layer structure shown in Table 1 was prepared. Coating solutions used were prepared as follows. Preparation of a coating solution for forming first layer:

27.2 ml of ethyl acetate and 7.9 ml of solvent (c) were added to a mixture of 19.1 g of yellow coupler (a) and 4.4 g of color image-stabilizing agent (b) to prepare a solution. This solution was emulsified and dispersed in 185 ml of a 10% gelatin aqueous solution containing 8 ml of 10% sodium dodecylbenzenesulfonate. Separately, 90 g of a blue-sensitive emulsion was prepared by adding to a silver chlorobromide emulsion (AgBr: 80 mol%; content of Ag: 70 g/kg), a blue-sensitive sensitizer as shown below in an amount of $7.0\times10^{-4}$ mol per mol of silver chlorobromide. The emulsion dispersion and the emulsion were mixed with each other to prepare a solution, and gelatin concentration of the resulting solution was adjusted so as to realize the formulation shown in Table 1 to prepare the coating solution for forming first layer. Coating solutions for forming second to seventh layers were also prepared in the same manner as with the coating solution for forming first layer. As a gelatin hardener for each layer, 1-hydroxy-3,5-dichloro-s-triazine sodium salt was used.

As spectral sensitizers for respective layers, the following were used.

Blue-sensitive emulsion layer:

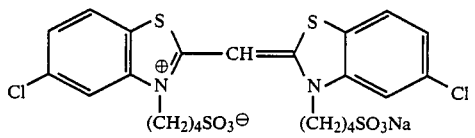

(added in an amount of $7.0\times10^{-4}$ mol per mol of silver halide).

Green-sensitive emulsion layer:

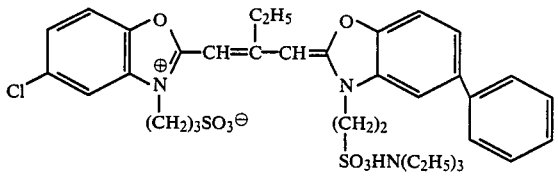

(added in an amount of $4.0\times10^{-4}$ mol per mol of silver halide).

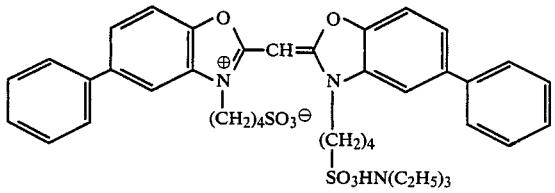

(added in an amount of $7.0\times10^{-5}$ mol per mol of silver halide).

Red-sensitive emulsion layer:

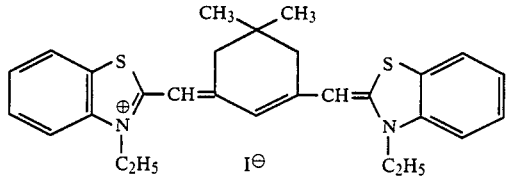

(added in an amount of $1.0\times10^{-4}$ mol per mol of silver halide).

As irradiation-preventing dyes for respective emulsion layers, the following were used.

Green-sensitive emulsion layer:

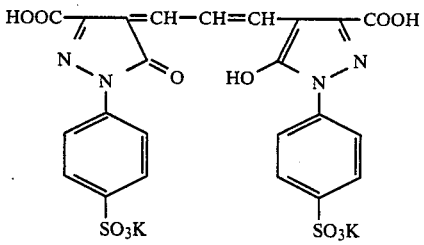

Red-sensitive emulsion layer:

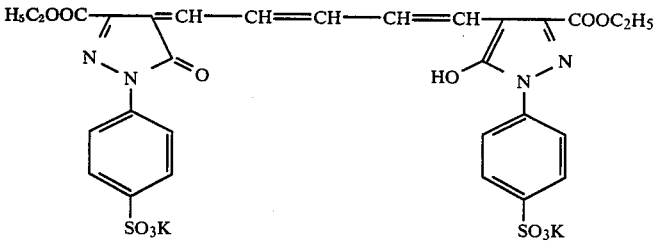

Structural formulae of couplers and related compounds used in this Example are shown below.

(a) Yellow coupler:

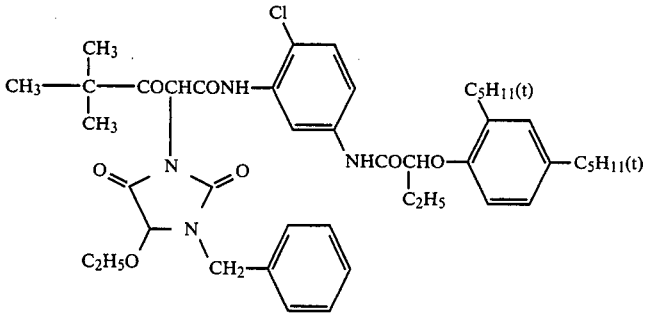

(b) Color image-stabilizing agent:

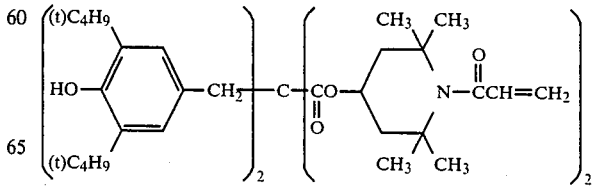

(c) Solvent

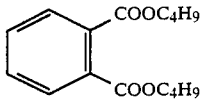
(d) Color stain preventing agent
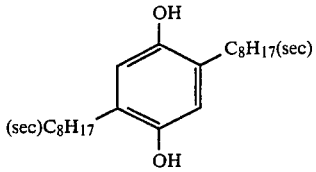
(e) Magenta coupler:
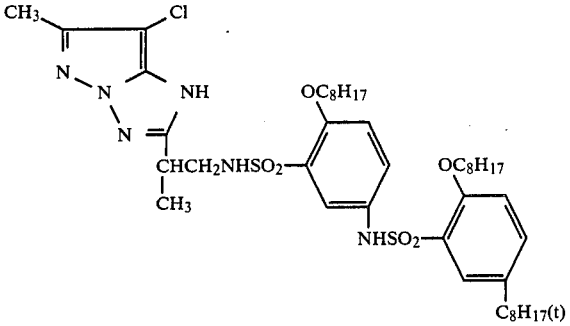
(f) Color image-stabilizing agent:
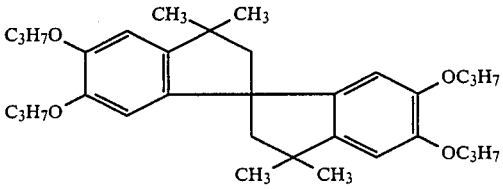
(g) Solvent:
Mixture of $(C_8H_{17}O)_3P{=}O$ and (
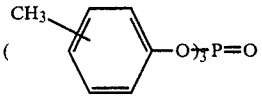
(2:1 by weight)
(h) Ultraviolet absorbent:
Mixture of
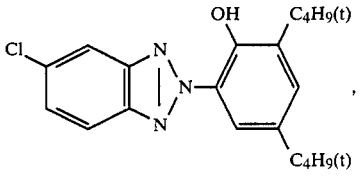
,
-continued
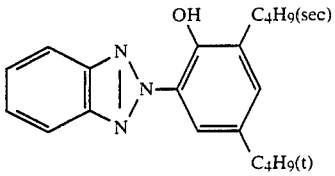
and
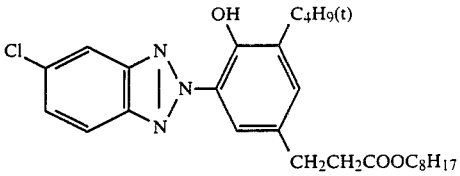
(1/5/3 by molar ratio)
(i) Color stain preventing agent
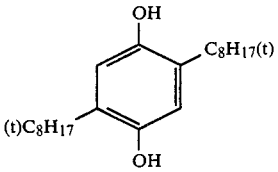
(j) Solvent
$(iso{-}C_9H_{19}O)_3P{=}O$
(k) Cyan coupler:
Mixture of
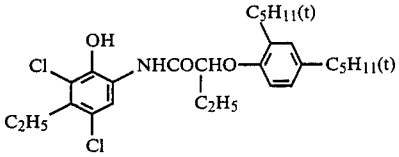
(k1)
and
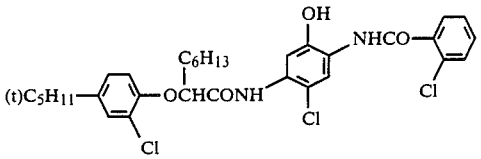
(k2)
(1/1 by molar ratio)
(l) Color image-stabilizing agent:
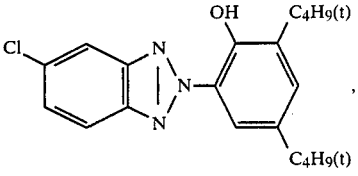
, -continued

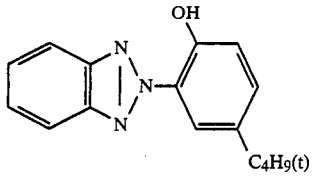

and

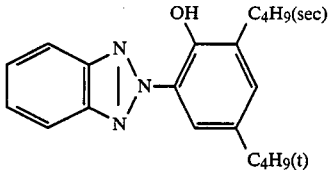

(1/3/3 by molar ratio)

(m) Solvent:

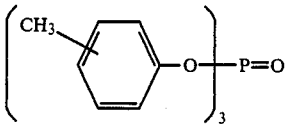

TABLE 1

| Layer | Main Formulation | Amount Used |
|---|---|---|
| 7th Layer (Protective layer) | Gelatin | 1.33 g/m$^2$ |
| | Acryl-modified copolymer of polyvinyl alcohol (modification degree: 17%) | 0.17 g/m$^2$ |
| 6th Layer (UV absorbing layer) | Gelatin | 0.54 g/m$^2$ |
| | Ultraviolet absorbent (h) | 0.21 g/m$^2$ |
| | Solvent (j) | 0.09 ml/m$^2$ |
| 5th Layer (Red-sensitive layer) | Silver chlorobromide emulsion (AgBr: 70 mol %), silver amount: | 0.26 g/m$^2$ |
| | Gelatin | 0.98 g/m$^2$ |
| | Cyan coupler (k) | 0.38 g/m$^2$ |
| | Color image-stabilizing agent (l) | 0.17 g/m$^2$ |
| | Solvent (m) | 0.23 ml/m$^2$ |
| 4th Layer (UV absorbing layer | Gelatin | 1.60 g/m$^2$ |
| | Ultraviolet absorbent (h) | 0.62 g/m$^2$ |
| | Color stain preventing agent (i) | 0.05 g/m$^2$ |
| | Solvent (j) | 0.26 ml/m$^2$ |
| 3rd Layer (Green-sensitive layer) | Silver chlorobromide emulsion (AgBr: 80 mol %), silver amount: | 0.16 g/m$^2$ |
| | Gelatin | 1.80 g/m$^2$ |
| | Magenta coupler (e) | 0.34 g/m$^2$ |
| | Color image-stabilizing agent (f) | 0.20 g/m$^2$ |
| | Solvent (g) | 0.68 ml/m$^2$ |
| 2nd Layer (Color stain preventing layer | Gelatin | 0.99 g/m$^2$ |
| | Color stain preventing agent (d) | 0.08 g/m$^2$ |
| 1st Layer (Blue-sensitive layer) | Silver chlorobromide emulsion (AgBr: 80 mol %), silver amount | 0.30 g/m$^2$ |
| | Gelatin | 1.86 g/m$^2$ |
| | Yellow coupler (a) | 0.82 g/m$^2$ |
| | Color image-stabilizing agent (b) | 0.19 g/m$^2$ |
| | Solvent (c) | 0.34 g/m$^2$ |
| Support | Polyethylene-laminated paper (a white pigment ($TiO_2$) and a blue dye (Ultramarine) being contained in polyethylene on the first layer side) | |

Silver halide emulsion (1 ) for the green-sensitive emulsion layer of the present invention was prepared as follows.

| | |
|---|---|
| (Solution 1) | |
| $H_2O$ | 1000 ml |
| NaCl | 5.5 g |
| Gelatin | 25 g |
| (Solution 2) | |
| Sulfuric acid (1N) | 20 ml |
| (Solution 3) | |
| Silver halide solvent of the following structure (1%) | 2 ml |

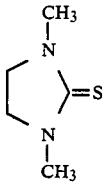

| | |
|---|---|
| (Solution 4) | |
| KBr | 2.80 g |
| NaCl | 0.34 g |
| $H_2O$ to make | 140 ml |
| (Solution 5) | |
| $AgNO_3$ | 5 g |
| $H_2O$ to make | 140 ml |
| (Solution 6) | |
| KBr | 67.20 g |
| NaCl | 8.26 g |
| $K_2IrCl_6$ (0.001%) | 0.7 ml |
| $H_2O$ to make | 320 ml |
| (Solution 7) | |
| $AgNO_3$ | 120 g |
| $H_2O$ to make | 320 ml |

(Solution 1) was heated to 60° C., and (Solution 2) and (Solution 3) were added thereto. Then, (Solution 4) and (Solution 5) were simultaneously added thereto over a 9 minute period. After 10 minutes, (Solution 6) and (Solution 7) were simultaneously added thereto over a 45 minute period. Five minutes after the addition, the temperature was lowered, and mixture was freed of salts. Water and dispersed gelatin were added thereto, and the pH of the mixture was adjusted to 6.2 to obtain a monodispersed cubic silver chlorobromide emulsion having a mean grain size of 0.48 μm, a variation coefficient (value obtained by dividing the standard deviation (S) by mean grain size ($\bar{\gamma}$): $S/\bar{\gamma}$) of 0.08, and silver bromide content of 80 mol%.

Sodium thiosulfate was added to this emulsion to conduct optimal chemical sensitization.

Monodispersed cubic silver chlorobromide emulsion (2) having a mean grain size of 0.35 μm, a variation coefficient of 0.06, and a silver bromide content of 80 mol% was prepared in the same manner as described above except for reducing both reaction temperature and time.

Silver halide emulsion (3) for comparative green-sensitive emulsion layer was prepared as follows.

| | |
|---|---|
| (Solution 8) | |
| $H_2O$ | 700 ml |
| NaCl | 39.4 g |
| Gelatin | 28 g |
| (Solution 9) | |
| Sulfuric acid (1N) | 10 ml |
| (Solution 10) | |
| KBr | 78.4 g |
| $K_2IrCl_6$ (0.001%) | 0.7 ml |
| $H_2O$ to make | 800 ml |
| (Solution 11) | |
| $AgNO_3$ | 140 g |
| $H_2O$ to make | 800 ml |

(Solution 8) was heated to 60° C., and (Solution 9) was added thereto. Then, (Solution 10) was added thereto over a 40 minute period. Further, one minute after initiation of adding (Solution 10), (Solution 11) was added thereto over a 40 minute period. Five minutes after the addition, the temperature of the mixture was decreased, and salts were removed. Water and dispersed gelatin were added thereto to adjust the pH to 6.2. Thus, a poly-dispersed silver chlorobromide emulsion having a mean grain size of 0.45 μm, a variation coefficient of 0.27, and a silver bromide content of 80 mol% was obtained. Sodium thiosulfate was added to the resulting emulsion to conduct optimal chemical sensitization. The emulsions used in Example 1 are tabulated in Table 2.

TABLE 2

| Emulsion | Mean Grain Size (μm) | Variation Coefficient (S/γ) | Halide Composition (%) |
|---|---|---|---|
| (1) | 0.48 | 0.08 | Br = 80, Cl = 20 |
| (2) | 0.35 | 0.06 | Br = 80, Cl = 20 |
| (3) | 0.45 | 0.27 | Br = 80, Cl = 20 |

Coated samples shown in Table 3 were prepared by using the emulsions shown in Table 2 as an emulsion for the third layer (green-sensitive layer).

TABLE 3

| Sample | Emulsion | Comment |
|---|---|---|
| (A) | (1) | Comparative Example |
| (B) | (1) + (2), The dye was added after blending the emulsions. | Present Invention |
| (C) | (1) + (2), The emulsions were blended after adding thereto the dye. | Present Invention |
| (D) | (3) | Comparative Example |

Blending ratio (by weight) of (1)/(2) was 3/7

These samples (A), (B), (C), and (D) were subjected to wedge exposure through a green filter for sensitometry using a sensitometer (made by Fuji PHoto Film Co., Ltd.; model FWH; color temperature of light source: 3,200° K.). This exposure was conducted in such manner that exposure amount became 250 CMS for an exposure time of 0.5 second.

Then, the samples were subjected to processing A or B using color developer (A) or (B) having the following formulation. Each processing comprises a color-developing step, a bleach-fixing step, and a water-washing step. Developing times used were 1 minute, 2 minutes, and 3 minutes, to evaluate the photographic properties. Processing A and processing B are different from each other in that processing A uses developer (A) whereas processing B uses developer (B), and are the same in other contents. Results thus obtained are shown in Table 4.

Photographic properties were evaluated in terms of relative sensitivity, gradation in high density area, and maximum density (Dmax). Relative sensitivity is a relative value taking the sensitivity of the green-sensitive layer of each photographic material processed according to processing A wherein color-developing time is 2 minutes as 100. Sensitivity is presented as a relative value of a reciprocal of an exposure amount necessary to provide a density of minimum density ±0.5.

Gradation is high density areas (DH) is presented as a color density for an exposure amount which is more than a sensitivity point by 0.7 in logarithm of exposure amount (log E).

Results thus obtained are shown in Table 4.

| Processing steps | Temperature | Time |
|---|---|---|
| Developer | 38° C. | 1–3 min. |
| Bleach-fixing solution | 33° C. | 1.5 min. |
| Washing with water | 28–35° C. | 3.0 min. |

Formulation of developer:

| | |
|---|---|
| Color developer (A) | |
| Nitrilotriacetic acid.3Na | 2.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| $Na_2CO_3$ (monohydrate) | 30.0 g |
| Water to make | 1000 ml (pH 10.1) |
| Color developer (B) | |
| Nitrilotriacetic acid.3Na | 2.0 g |
| $Na_2SO_3$ | 2.0 g |
| KBr | 0.5 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| $Na_2CO_3$ (monohydrate) | 30.0 g |
| Water to make | 1000 ml (pH 10.1) |
| Formulation of bleach-fixing solution | |
| Ammonium thiosulfate (54 wt %) | 150 ml |
| $Na_2SO_3$ | 15 g |
| $NH_4[Fe(III)(EDTA)]$ | 55 g |
| EDTA.2Na | 4 g |
| Water to make | 1000 ml (pH 6.9) |

TABLE 4

| Sample | Processing A Developing Time | | | | | | | | | Processing B Developing Time | | | | | | | | | Remarks |
|---|---|---|---|---|---|---|---|---|---|---|---|---|---|---|---|---|---|---|---|
| | 1 minute | | | 2 minutes | | | 3 minutes | | | 1 minute | | | 2 minutes | | | 3 minutes | | | |
| | RS | DH | DMAX | RS | DH | Dmax | RS | DH | Dmax | RS | DH | Dmax | RS | DH | Dmax | RS | DH | Dmax | |
| A | 81 | 2.32 | 2.54 | 100 | 2.37 | 2.63 | 111 | 2.48 | 2.73 | 78 | 1.98 | 2.38 | 93 | 2.10 | 2.55 | 108 | 2.20 | 2.59 | Comparative Example |
| B | 82 | 2.31 | 2.52 | 100 | 2.37 | 2.61 | 114 | 2.48 | 2.72 | 79 | 2.30 | 2.50 | 92 | 2.35 | 2.60 | 109 | 2.46 | 2.70 | Present Invention |
| C | 83 | 2.33 | 2.53 | 100 | 2.38 | 2.62 | 115 | 2.50 | 2.72 | 81 | 2.30 | 2.51 | 99 | 2.36 | 2.60 | 113 | 2.46 | 2.69 | Pre- |

TABLE 4-continued

| Sample | Processing A Developing Time 1 minute RS | DH | DMAX | 2 minutes RS | DH | Dmax | 3 minutes RS | DH | Dmax | Processing B Developing Time 1 minute RS | DH | Dmax | 2 minutes RS | DH | Dmax | 3 minutes RS | DH | Dmax | Remarks |
|---|---|---|---|---|---|---|---|---|---|---|---|---|---|---|---|---|---|---|---|
| D | 59 | 2.00 | 2.29 | 100 | 2.21 | 2.54 | 121 | 2.59 | 2.67 | 39 | 1.35 | 1.52 | 64 | 1.74 | 1.95 | 81 | 1.94 | 2.10 | sent Invention Comparative Example |

RS: Relative sensitivity

As is clear from Table 4, samples B and C according to the present invention can provide a sufficient gradation in high density area even when processed according to processing B not using benzyl alcohol.

EXAMPLE 2

Silver halide emulsion (6) for a green-sensitive emulsion layer was prepared as follows.

| | |
|---|---|
| (Solution 12) | |
| $H_2O$ | 1000 ml |
| NaCl | 17.5 g |
| Gelatin | 25 g |
| (Solution 13) | |
| Sulfuric acid (1N) | 20 ml |
| (Solution 14) | |
| Silver halide solvent of the following structure (1%) | 3 ml |

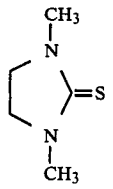

| | |
|---|---|
| (Solution 15) | |
| KBr | 17.5 g |
| $H_2O$ to make | 130 ml |
| (Solution 16) | |
| $AgNO_3$ | 25 g |
| $H_2O$ to make | 130 ml |
| (Solution 17) | |
| KBr | 52.50 g |
| NaCl | 8.60 g |
| $K_2IrCl_6$ (0.001%) | 0.7 ml |
| $H_2O$ to make | 285 ml |
| (Solution 18) | |
| $AgNO_3$ | 100 g |
| $H_2O$ to make | 285 ml |

(Solution 12) was heated to 60° C., and (Solution 13) and (Solution 14) were added thereto. Then, (Solution 15) and (Solution 16) were simultaneously added thereto over a 20 minute period. After 10 minutes, (Solution 17) and (Solution 18) were simultaneously added thereto over a 25 minute period. Five minutes after the addition, the temperature of the mixture was lowered, and desalting was conducted. Water and dispersed gelatin were added thereto, and pH was adjusted to 6.2 to obtain a monodispersed cubic silver chlorobromide emulsion having a mean grain size of 0.48 μm, a variation coefficient (value obtained by dividing the standard deviation (S) by means grain size ($\bar{\gamma}$): $S/\bar{\gamma}$) of 0.07, and a silver bromide content of 80 mol%.

To this emulsion was added sodium thiosulfate to provide optimal chemical sensitization.

In the same manner as described above except for reducing both reaction temperature and time, there were obtained monodisperse cubic silver chlorobromide emulsions having grain sizes as described in Table 5.

TABLE 5

| Emulsion | Mean Grain Size (μm) | Variation Coefficient ($S/\bar{\gamma}$) | Halide Composition (%) |
|---|---|---|---|
| (4) | 0.48 | 0.07 | Br = 80, Cl = 20 |
| (5) | 0.45 | 0.08 | Br = 80, Cl = 20 |
| (6) | 0.35 | 0.08 | Br = 80, Cl = 20 |
| (7) | 0.20 | 0.10 | Br = 80, Cl = 20 |

Emulsions shown in Table 5 were used as emulsions for a third layer (green-sensitive layer) in the same manner as in Example 1 to prepare coated samples shown in Table 6.

Photographic properties of the samples were evaluated in the same manner as in Example 1, to obtain the results in Table 7.

TABLE 6

| Sample | Emulsion | Blending Ratio (by weight) | $(\bar{\gamma}_1/\bar{\gamma}_2)$ |
|---|---|---|---|
| E | (4) + (5) | (4)/(5) = 3/7 | 1.14 |
| F | (4) + (6) | (4)/(6) = 3/7 | 1.88 |
| G | (4) + (7) | (4)/(7) = 3/7 | 5.76 |

With samples E to G, emulsions were blended after adding sensitizing dyes to respective emulsions.

TABLE 7

| Sample | Processing A Developing Time 1 minute RS | DH | Dmax | 2 minutes RS | DH | Dmax | 3 minutes RS | DH | Dmax | Processing B Developing Time 1 minute RS | DH | Dmax | 2 minutes RS | DH | Dmax | 3 minutes RS | DH | Dmax | Remarks |
|---|---|---|---|---|---|---|---|---|---|---|---|---|---|---|---|---|---|---|---|
| E | 82 | 2.33 | 2.52 | 100 | 2.37 | 2.62 | 115 | 2.50 | 2.71 | 80 | 2.28 | 2.41 | 98 | 2.32 | 2.58 | 109 | 2.39 | 2.61 | Present Inven- |

TABLE 7-continued

| Sample | Processing A Developing Time | | | | | | | | | Processing B Developing Time | | | | | | | | | Remarks |
|---|---|---|---|---|---|---|---|---|---|---|---|---|---|---|---|---|---|---|---|
| | 1 minute | | | 2 minutes | | | 3 minutes | | | 1 minute | | | 2 minutes | | | 3 minutes | | | |
| | RS | DH | Dmax | RS | DH | Dmax | RS | DH | Dmax | RS | DH | Dmax | RS | DH | Dmax | RS | DH | Dmax | |
| | | | | | | | | | | | | | | | | | | | tion |
| F | 84 | 2.34 | 2.54 | 100 | 2.39 | 2.63 | 116 | 2.51 | 2.72 | 81 | 2.31 | 2.51 | 98 | 2.37 | 2.61 | 111 | 2.46 | 2.68 | Present Invention |
| G | 61 | 2.34 | 2.55 | 100 | 2.30 | 2.66 | 121 | 2.43 | 2.76 | 60 | 2.30 | 2.53 | 99 | 2.21 | 2.64 | 118 | 2.37 | 2.72 | Present Invention |

RS: Relative sensitivity

As is clear from Table 7, it is seen that enough gradation in high density area can be obtained by 2-minute development according to processing B using a color developer not containing benzyl alcohol. Further, comparison of those samples clearly reveals that sample F of 1.88 in $(\bar{\gamma}_1/\bar{\gamma}_2)^2$ is particularly excellent. Sample G showed a soft tone in high density area when processed according to processing A.

The present invention enables the substantial elimination of benzyl alcohol, markedly reducing the load of environmental pollution, lightening the work of preparing processing solutions, and preventing reduction in density due to the presence of remaining leuco-form cyan dye. Further, it enables rapid processing of a large quantity of prints, to thereby remarkably increase productivity. In addition, according to the present invention, even when developemnt is conducted for a short time using a substantially benzyl alcohol-free color developer, good color prints can be obtained which have an enough high color density in the shoulder part of characteristic curve and have a quite contrasty tone from highlight area to shadow area.

While the invention has been described in detail and with reference to specific embodiments thereof, it will be apparent to one skilled in the art that various changes and modifications can be made therein without departing from the spirit and scope thereof.

What is claimed is:

1. A color image-forming process which comprises imagewise exposing a silver halide photographic material comprising a reflective support having provided thereon at least one light-sensitive silver halide emulsion layer constituted by at least two kinds of monodispersed silver halide grains which are free of silver iodide and substantially differ from each other in mean grain size, and developing the exposed photographic material for a developing time of within 2 minutes and 30 seconds using a color developer containing substantially no benzyl alcohol, wherein the two kinds of monodispersed silver halide grains which are respectively the most and the second most by weight, among said at least two kinds of monodispersed silver halide grains, satisfy the conditions of $$1.2 \leqq (\bar{\gamma}_1/\bar{\gamma}_2)^2 \leqq 4.0,$$

wherein $\bar{\gamma}_1$ represents the mean grain size of the larger kind of grains, and $\bar{\gamma}_2$ represents the mean grain size of the smaller kinds of grains, and wherein the monodispersed silver halide grains form a latent image predominantly on the surface thereof upon exposure to light.

2. A color image-forming process as in claim 1, wherein two kinds of monodispersed silver halide grains which are respectively the most and the second most by weight, among said at least two kinds of monodispersed silver halide grains, satisfy the conditions of $$1.4 \leqq (\bar{\gamma}_1/\bar{\gamma}_2)^2 \leqq 3.2,$$

wherein $\bar{\gamma}_1$ represents the mean grain size of the larger kind of grains, and $\bar{\gamma}_2$ represents the mean grain size of the smaller kind of grains.

3. A color image-forming process as in claim 1, wherein each of the kinds of monodispersed silver halide grains has a statistical standard deviation (S) of the grain size distribution to the mean grain size ($\bar{\gamma}$), a variation coefficient ($S/\bar{\gamma}$), of not more than 0.2.

4. A color image-forming process as in claim 1, wherein each of the kinds of monodispersed silver halide grains has a statistical standard deviation (S) of the grain size distribution to the mean grain size ($\bar{\gamma}$), a variation coefficient ($S/\bar{\gamma}$), of not more than 0.15.

5. A color image-forming process as in claim 1, wherein $\bar{\gamma}_1$ and $\bar{\gamma}_2$ are each within the range of from 0.1 μm to 2.0 μm.

6. A color image-forming process as in claim 1, wherein $\bar{\gamma}_1$ and $\bar{\gamma}_2$ are each within the range of from 0.2 μm to 1.3 μm.

7. A color image-forming process as in claim 2, wherein $\bar{\gamma}_1$ and $\bar{\gamma}_2$ are each within the range of from 0.1 μm to 2.0 μm.

8. A color image-forming process as in claim 2, wherein $\bar{\gamma}_1$ and $\bar{\gamma}_2$ are each within the range of from 0.2 μm to 1.3 μm.

9. A color image-forming process as in claim 1, wherein the sum of the monodispersed emulsions having mean grain sizes of $\bar{\gamma}_1$ and $\bar{\gamma}_2$, respectively, is 70% or more by weight based on the total silver halide emulsions contained in the light-sensitive emulsion layer.

10. A color image-forming process as in claim 1, wherein the sum of the monodispersed emulsions having mean grain sizes of $\bar{\gamma}_1$ and $\bar{\gamma}_2$, respectively, is 80% or more by weight based on the total silver halide emulsions contained in the light-sensitive emulsion layer.

11. A color image-forming process as in claim 2, wherein the sum of the monodispersed emulsions having mean grain sizes of $\bar{\gamma}_1$ and $\bar{\gamma}_2$, respectively, is 70% or more by weight based on the total silver halide emulsions contained in the light-sensitive emulsion layer.

12. A color image-forming process as in claim 2, wherein the sum of the monodispersed emulsions having mean grain sizes of $\bar{\gamma}_1$ and $\bar{\gamma}_2$, respectively, is 80% or more by weight based on the total silver halide emulsions contained in the light-sensitive emulsion layer.

13. A color image-forming process as in claim 1, wherein the weight ratio of monodispersed emulsion having a mean grain size of $\bar{\gamma}_2$ to monodispersed emulsion having a mean grain size of $\bar{\gamma}_1$ is in the range of from 5/95 to 80/20.

14. A color image-forming process as in claim 1, wherein the weight ratio of monodispersed emulsion having a mean grain size of $\bar{\gamma}_2$ to monodispersed emulsion having a mean grain size of $\bar{\gamma}_1$ is in the range of from 10/90 to 70/30.

15. A color image-forming process as in claim 2, wherein the weight ratio of monodispersed emulsion having a mean grain size of $\bar{\gamma}_2$ to monodispersed emulsion having a mean grain size of $\bar{\gamma}_1$ is in the range of from 5/95 to 80/20.

16. A color image-forming process as in claim 2, wherein the weight ratio of monodispersed emulsion having a mean grain size of $\bar{\gamma}_2$ to monodispersed emulsion having a mean grain size of $\bar{\gamma}_1$ is in the range of from 10/90 to 70/30.

17. A color image-forming process as in claim 1, wherein the monodispersed silver halide grains comprise silver chloride or silver chlorobromide.

18. A color image-forming process as in claim 17, wherein silver chlorobromide contains from 20 to 98 mol% of silver bromide.

19. A color image-forming process as in claim 17, wherein silver chlorobromide contains from 50 to 98 mol% of silver bromide.

20. A color image-forming process as in claim 17, wherein silver chlorobromide contains 80 mol% or more of silver chloride.

21. A color image-forming process as in claim 17, wherein the monodispersed silver chlorobromide grains have a core/shell structure wherein the shell portion has a larger amount of silver chloride content than does the core portion.

22. A color image-forming process as in claim 1, wherein wherein at least two kinds of monodispersed silver halide emulsions are blended after adding thereto a spectrally sensitizing dye.

23. A color image-forming process as in claim 1, wherein the processing time is from 1 minute to 2 minutes and 10 seconds.

24. A color image-forming process as in claim 1, wherein the developing temperature is from 30° to 50° C.

25. A color image-forming process as in claim 24, wherein the developing temperature is from 35° to 45° C.

26. A color image-forming process as in claim 1, wherein the color developer contains 3-methyl-4-amino-N-ethyl-N-β-hydroxyethylaniline or 3-methyl-4-amino-N-ethyl-N-β-methanesulfonamidoethylaniline.

27. A color image-forming process as in claim 26, wherein the color developer contains 3-methyl-4-amino-N-ethyl-N-β-methanesulfonamidoethylaniline.

* * * * *